US010029765B2

(12) United States Patent
Jourdan et al.

(10) Patent No.: US 10,029,765 B2
(45) Date of Patent: Jul. 24, 2018

(54) SUBMERGED OBJECT SUSPENDED FROM A TOWING CABLE OPTIMIZED TO NEUTRALIZE DISRUPTING HYDRODYNAMIC FORCES

(71) Applicants: THALES, Courbevoie (FR); Michaël Jourdan, Plouzane (FR)

(72) Inventors: Michaël Jourdan, Plouzane (FR); Christophe Borel, Brest (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 15/515,579

(22) PCT Filed: Oct. 1, 2015

(86) PCT No.: PCT/EP2015/072740
§ 371 (c)(1),
(2) Date: Mar. 29, 2017

(87) PCT Pub. No.: WO2016/050936
PCT Pub. Date: Apr. 7, 2016

(65) Prior Publication Data

US 2017/0291666 A1 Oct. 12, 2017

(30) Foreign Application Priority Data

Oct. 1, 2014 (FR) ..... 14 02209

(51) Int. Cl.
*B63B 21/66* (2006.01)

(52) U.S. Cl.
CPC ..... *B63B 21/66* (2013.01); *B63B 2211/02* (2013.01)

(58) Field of Classification Search
CPC ..... B63B 21/66
See application file for complete search history.

(56) References Cited

U.S. PATENT DOCUMENTS 4,175,432 A 11/1979 Gibson
6,615,762 B1 * 9/2003 Scott ..... B63B 7/04 114/353

FOREIGN PATENT DOCUMENTS

FR 2 397 974 A1 2/1979
FR 2 774 063 A1 7/1999
FR 2 982 579 A1 5/2013

* cited by examiner

*Primary Examiner* — Stephen P Avila
(74) *Attorney, Agent, or Firm* — Baker & Hostetler LLP

(57) ABSTRACT

An object that can be towed in a fluid by a cable along a substantially horizontal transport axis comprises a body suspended under gravity from the cable by a fixing arm, and an exterior hydrodynamic surface that is symmetric with respect to a vertical plane containing the transport axis, so as to limit the lateral lift of the body, and an opening passing through the body along a vertical axis and configured to equalize the pressures of fluid flowing along the exterior surface, making it possible to limit the hydrodynamic forces that may be generated perpendicular to the transport axis giving rise to a force in rotation about the transport axis opposing the effect of gravity.

24 Claims, 5 Drawing Sheets

SUBMERGED OBJECT SUSPENDED FROM A TOWING CABLE OPTIMIZED TO NEUTRALIZE DISRUPTING HYDRODYNAMIC FORCES

CROSS-REFERENCE TO RELATED APPLICATIONS

This application is a National Stage of International patent application PCT/EP2015/072740, filed on Oct. 1, 2015, which claims priority to foreign French patent application No. FR 1402209, filed on Oct. 1, 2014, the disclosures of which are incorporated by reference in their entirety.

FIELD OF THE INVENTION

The present invention relates to an object intended to be towed in a fluid, comprising means for neutralizing hydrodynamic forces generated by the flow of fluid around the object, for example induced by asymmetries of a towing device. The invention finds a particular use in the field of underwater acoustics, notably for towed active sonars.

BACKGROUND

Towed active sonars comprise an emission antenna integrated into a submersible object also referred to as a towfish, and a receive antenna, for example a linear array, also referred to as a streamer. When the sonar is being used in dependent towing, the towfish and the streamer are connected in succession to one and the same towing cable. FIG. 1 illustrates a known configuration of an active sonar in dependent towing. The deck of the ship 10 is equipped with a towing device comprising a motorized winch 11 capable, via a fairlead 15, of towing a cable 12 to which are connected on the one hand a towfish 13 and on the other hand a streamer 14.

During a sonar mission, the streamer and then the towfish are first of all launched into the water by the deck crew. The towfish and the streamer are then towed by the ship at the desired depth of immersion, determined by the length of the cable and the speed of the ship. The emission and receive antennas are generally controlled from the ship, via electrical and/or optical information transmitted via conductors integrated into the towing cable. At the end of the mission, the towfish and the streamer are brought back up and placed on the deck.

In the known way, the emission antenna emits, by means of one or more transducers, an acoustic wave directed toward the seabed or into the column of water. The wave reflected off the seabed or off an object situated in the column of water is then detected by the acoustic receiver. A signal processing device operating on the signal received then allows the seabed or the detected object to be imaged. A precise measurement requires that the towed elements achieve good stability, particularly the acoustic antenna, so as to allow stable angular coverage. For that, the towfish is generally made of a submersible body suspended from the towing cable by means of fixing arms, which under the effect of gravity are able to generate a moment that tends to keep the towfish plumb.

This return moment generated by gravity may sometimes prove insufficient to ensure good stability of the towed object. Specifically, the flow of water around the object generates hydrodynamic forces the intensity of which increases with the speed of towing. These hydrodynamic forces may generate a rolling moment about the transport axis of the object, a pitching moment or even a yawing moment and unsettle the towed object by acting against the gravity return moment.

These disrupting hydrodynamic forces are particularly significant in instances in which the towed object has a shape that is asymmetric about one of these axes. The applicant company's patent document published under the reference FR2982579 and describing an articulated fairlead intended to optimize the operations of launching and retrieving the towfish is thus known. Such a towing device offers numerous advantages: it guarantees a minimum bend radius for the towing cable and makes it easier for the towed body to pass through the fairlead, making it possible to dispense with one articulated arm for grabbing hold of the towed body when raising the cable back up. The use of this articulated fairlead does, however, require the fixing arm to pass laterally. For this reason, the towed body has an architecture that is asymmetric. This physical asymmetry generates an asymmetry in the lift which may, for high towing speeds, notably for speeds corresponding to a Froude number (V/root (g*L), where V is speed in m/s, g is the constant due to gravity, L is the length of the body) at least equal to 1.5 and potentially exceeding 3, cause the towed body to rotate about the towing cable. At low speed, gravity is enough to stabilize the object.

Attempts are therefore being made to improve the stability of a submersible body the towing means of which exhibit asymmetry. More generally, it remains desirable to have available means for stabilizing the orientation in roll, pitch and yaw, of a body towed in a fluid by a cable.

SUMMARY OF THE INVENTION

To this end, the invention relates to an object intended to be towed in a fluid by a cable along a substantially horizontal transport axis; the object comprising a body intended to be suspended under the effect of gravity from the cable by means of a fixing arm, the object being characterized in that the body comprises:

an exterior hydrodynamic surface that is symmetric with respect to a vertical plane containing the transport axis so as to limit the lateral lift of the body, and an opening passing through the body along a vertical axis, which opening is intended to be occupied by the fluid so as to equalize the pressures of fluid flowing along the exterior surface, so as to limit the vertical lift of the body;

making it possible to limit the hydrodynamic forces that may be generated perpendicular to the transport axis by the flow of fluid around the body and that are liable to lead to a load in rotation about the transport axis by opposing the effect of gravity. The object comprises at least one fixing arm.

Advantageously, the body is a single-shell monocoque.

Advantageously, the fixing arm has a shape that is asymmetric with respect to the vertical plane containing the transport axis.

Advantageously, the fixing arm has the overall shape of a "C", connected by a first end to the body and intended to be connected by a second end to the cable.

Advantageously, the object comprises a ballast weight positioned inside the body and configured so that the center of gravity of the object maintained at zero speed in the fluid is positioned in the vertical plane containing the transport axis.

Advantageously, the object comprises a ballast weight positioned inside the body and configured so that the center of gravity of the object kept immersed in air at zero speed is positioned in the vertical plane containing the transport axis.

Advantageously, the object comprises a ballast weight positioned inside the body and configured so that the center of gravity of the object is positioned in the vertical plane containing the transport axis both when the object is kept submerged at zero speed in water and when the object is kept immersed at zero speed in air.

Advantageously, the object comprises a set of deflectors secured to the body, configured to generate a hydrodynamic force by the flow of fluid around the object that neutralizes the hydrodynamic force induced by the asymmetric shape of the fixing arm.

Advantageously, the exterior surface comprises an upper surface and a lower surface.

Advantageously, the lower surface and the upper surface are symmetric with respect to one another about a horizontal plane so as to limit the vertical lift of the body.

Advantageously, the upper surface and/or the lower surface is configured so as to form in the vertical plane containing the transport axis a thick NACA-type profile making it possible to limit the vertical lift of the body.

Advantageously, the exterior surface is configured so as to form in the horizontal plane a thick NACA-type profile making it possible to limit the lateral lift of the body.

Advantageously, the exterior surface is configured to form, in a vertical plane perpendicular to the transport axis, a curved profile, comprising a small vertical portion so as to limit the lateral lift of the body.

Advantageously, the body comprises a lateral opening passing through the body along a horizontal axis perpendicular to the transport axis and situated in a downstream part of the body so as to limit the lateral lift of the body.

Advantageously, the opening is intended to be occupied by the fluid.

Advantageously, the exterior surface comprises an upper surface and a lower surface, the upper surface and the lower surface being configured so that the exterior surface forms:

in the horizontal plane a thick NACA-type profile making it possible to limit the lateral lift of the body;

in a vertical plane containing the transport axis, a thick NACA-type profile making it possible to limit the vertical lift of the body, the opening opening on the one hand onto the upper surface and on the other hand onto the lower surface.

Advantageously, the body is wholly delimited by the exterior surface.

Advantageously, the body comprises a lateral opening passing through the body along a horizontal axis perpendicular to the transport axis and situated in a downstream part of the body so as to limit the lateral lift of the body.

Advantageously, the object comprises a substantially vertical aileron fixed on a downstream part of the body having a substantially asymmetric hydrodynamic shape configured to stabilize the orientation of the object by generating a moment about a vertical axis.

Advantageously, the object comprises a substantially horizontal aileron fixed on a downstream part of the body having a substantially asymmetric hydrodynamic shape configured to stabilize the orientation of the object by generating a moment about the transport axis.

Advantageously, the object comprises two fixing arms configured so as to connect, in first and second substantially vertical directions respectively, the cable and, respectively, a first and a second end of the body along the transport axis, so that a force tending to separate the two fixing arms makes it possible to stabilize the body about a vertical axis.

Advantageously, the object is intended for sonar detection in a marine environment, and comprising an acoustic emission antenna fixed to an internal structure of the body.

The invention also relates to an active sonar system intended to be towed by a ship and comprising a towing cable that can be connected to the ship and an object towed by the cable and having features as described hereinabove.

Advantageously, the active sonar comprises a tail containing a longilinear body for receiving acoustic signals.

BRIEF DESCRIPTION OF THE DRAWINGS

The invention will be better understood and further advantages will become apparent from reading the detailed description of one example of a towed submersible object which is described in the following figures.

For the sake of clarity, the same elements will bear the same references in the various figures.

DETAILED DESCRIPTION

Figure 1:
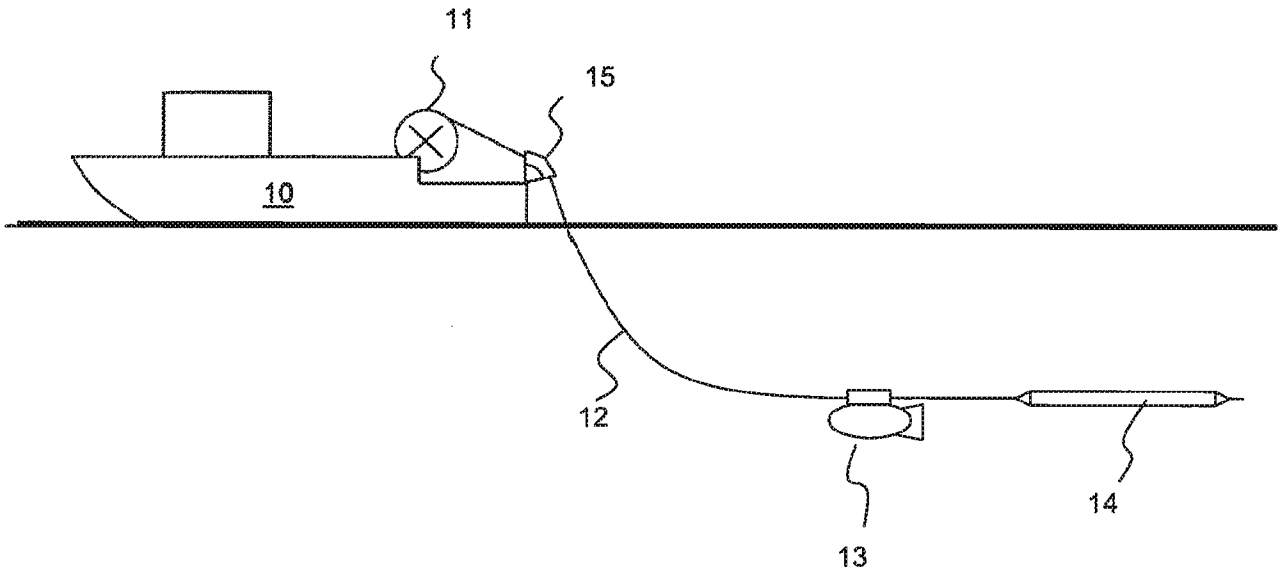
FIG. 1, already introduced, illustrates the use of a towed active sonar according to the known state of the art.

In the example depicted in FIGS. 2*a*, 2*b*, 2*c* and 2*d*, the towed object 20 comprises a submersible body 21 intended to receive within its structure an emission antenna of an active sonar, and connected to the towing cable 12 via two fixing arms 22*a* and 22*b*. In a configuration similar to the one depicted in FIG. 1, the cable 12 from which the body 21 is suspended is connected by an end situated upstream of the body to a motorized winch similar to the winch 11, and by another end situated downstream of the body to a receive antenna 14. The towed object 20 therefore constitutes the towfish 13 of the active sonar in dependent towing described previously. It should be understood that this particular embodiment is not a limitation on the present invention which relates more broadly to any type of body intended to be towed in any type of fluid by means of a towing cable.

The body is significantly heavy in water, which means to say that it has negative buoyancy. What is meant by significantly is that the upthrust of the body is typically less than 80% of its weight in air.

The body is suspended from the towing cable by means of two asymmetric fixing arms 22*a* and 22*b* which allow the fixing arms to pass laterally through an articulated fairlead analogous to the one described in the patent application cited in the preamble. The invention is of particular utility in stabilizing such a body of which the design of the means that fix it to the cable exhibits asymmetry inducing significant hydrodynamic forces liable to generate a disrupting moment about the towing cable. This particular embodiment implies no limit on the invention which may also be applied to stabilizing the towing of a body that does not have this asymmetry of the fixing means.

The invention relates to a towed object comprising a body suspended under the effect of gravity from a towing cable by means of at least one fixing arm. The towing cable is intended to tow the object along a substantially horizontal transport axis. Hereinafter, the towed object is thus defined with respect to a vertical axis along which the force of gravity is applied, and a substantially horizontal transport axis defining the main direction of the flow of the fluid. Of course, the invention may also apply to cases in which the object is towed in a direction that is not strictly horizontal, but slightly upward or slightly downward. What is meant by substantially horizontal is an axis that preferably makes an angle smaller than 10 degrees with the horizontal plane. This value does not constitute a limit on the invention. The detailed definition of an object allowing, in the case of movement that is not strictly horizontal, the effect of the hydrodynamic forces to be limited so as to stabilize the towing of the object, can be deduced easily from the example described hereinbelow.

In the remainder of the document, the towed object is described with reference to a frame of reference made up of an axis of movement—or axis of roll—referenced X in the figures, preferably aligned between the fixing arms with the longitudinal axis of the towing cable 12; of a yaw axis referenced Z, corresponding to the vertical axis passing through the center of gravity of the object; and of a pitch axis referenced Y, corresponding to the horizontal axis perpendicular to the roll axis.

The general idea behind the present invention is that of reaching equilibrium between the forces of gravity exerted on the towed object and the hydrodynamic forces generated by the flow of fluid around the object as it is being towed. The object uses various measures that contribute to achieving this equilibrium and obtaining an architecture that is stable throughout the range of operational speeds. These measures will now be described with reference to FIGS. 2*a* to 2*d*.

The weight in water of the object suspended from the cable is the key factor to stabilizing the system about its roll axis. This of course assumes that the center of gravity is offset from the axis of the supporting cable, which it is as the cable is fixed to the top of the body. In order to be effective, it is considered that the distance separating the center of gravity of the object from the cable is at least equal to half the vertical thickness of the body 51 in a vertical plane. The vertical thickness is defined later on. Increasing the weight of the object in order to increase its stability is, however, limited by the capacity of the launch and recovery means. In practice, the weight of the object is therefore defined as being a compromise between the improvement in stability and the ease of object launch and recovery operations.

The length of the fixing arm is another factor in stabilizing the object in roll. The magnitude of the return moment in roll generated by the weight is in direct proportion to the distance separating the center of gravity of the object from the cable 12. Increasing the lever arm through the length of the fixing arms makes it possible to increase the return moment in roll.

However, long fixing arms reduce the pitch stabilization achieved by fixing the two fixing arms to the cable. Specifically, the hydrodynamic forces generated by the flow of fluid around the object are situated chiefly in the region of the body. Thus, increasing the lever arm for the return moment in roll by increasing the length of the fixing arms also increases the lever arm of the destabilizing effect in pitching. That also increases the destabilizing effect in roll when the object is at a yaw angle. In practice, an intermediate length is adopted for the fixing arms, as in the example depicted in the figures.

The body is suspended from the cable by means of the fixing arms 22*a* and 22*b*. To allow lateral passage through the fairlead, the fixing arms are in the overall shape of a "C" having asymmetry with respect to the vertical plane containing the transport axis X. This asymmetry of weight is likely to cause an inclination at zero speed with respect to a vertical plane of symmetry referenced $P_{SV}$ containing the transport axis X. In order to compensate for the force of gravity exerted on the fixing arms and to stabilize the orientation of the body with respect to the vertical plane $P_{SV}$, a ballast weight is fixed inside the body. The parameters used to define this weight are indicated in FIG. 2*d*. In this figure:

- $P_B$ is the position of the center of gravity of the components exhibiting asymmetry with respect to the vertical plane containing the transport axis. In the example depicted, this is the center of gravity of the two fixing arms 22*a* and 22*b*.
- $P_L$ is the position of the center of gravity of the ballast weight fixed inside the body.
- $P_C$ is the position of the center of gravity of the object as a whole, including the fixing arms and the body fitted with its ballast weight.

To facilitate the operation of recovering the towed object in the air, the desire is to position the center of gravity of the object in the vertical plane of symmetry $P_{SV}$. The following relationship makes it possible to determine the position of the ballast weight that will make it possible to cancel the listing of the object in the air:

$$m_L*D_L=m_B*D_B \tag{1}$$

in which:

- $m_L$ is the mass of the ballast weight,
- $D_L$ is the distance from the center of gravity to the vertical symmetry plane,
- $m_B$ is the mass of the asymmetric elements, and
- $D_B$ is the distance from the center of gravity to the vertical symmetry plane.

It is also desired to obtain a zero listing when the object is immersed in water at zero speed. To achieve that, the object needs to satisfy the following relationship:

$$m_L*(d_L-d_E)=m_B*(d_B-d_E) \tag{2}$$

in which:

- $d_L$ is the density of the ballast weight,
- $d_B$ is the density of the asymmetric elements, and
- $d_E$ is the density of the water in which the object is moving.

Solving equations (1) and (2) makes it possible to define the density and position of the ballast weight in the body, so as to balance the object kept at zero speed both in air and in water. That makes it possible to obtain good acoustic measurements in the water and make it easier to recover the object in the air. FIG. 2*d* describes the positioning of the ballast weight that makes it possible to obtain a zero listing for the towed object 20. Note that in order not to disrupt the flow of water around the body, the ballast weight is advantageously positioned inside the structure, under the streamlining.

The return moment in roll for the object thus defined may be expressed by a relationship of the type:

$$C_R=(D_C*m_C-D_V*V*d_E)*g*\sin(\alpha) \tag{3}$$

in which:

- $D_C$ is the distance between the center of gravity and the cable,
- $m_C$ is the total mass of the object,
- $D_V$ is the distance between the center of volume $C_dV$ of the object and the cable,
- V is the total volume of the object,
- $d_E$ is the density of the water in which the object is moving, g is the acceleration due to gravity, and $\alpha$ is the angle of roll.

In order to stabilize the towed object it is appropriate to ensure that this gravity return moment $C_R$ remains higher, throughout the envisioned speed range, than the moments generated by the hydrodynamic forces about the roll axis. There are various measures taken toward this.

Figure 2A:
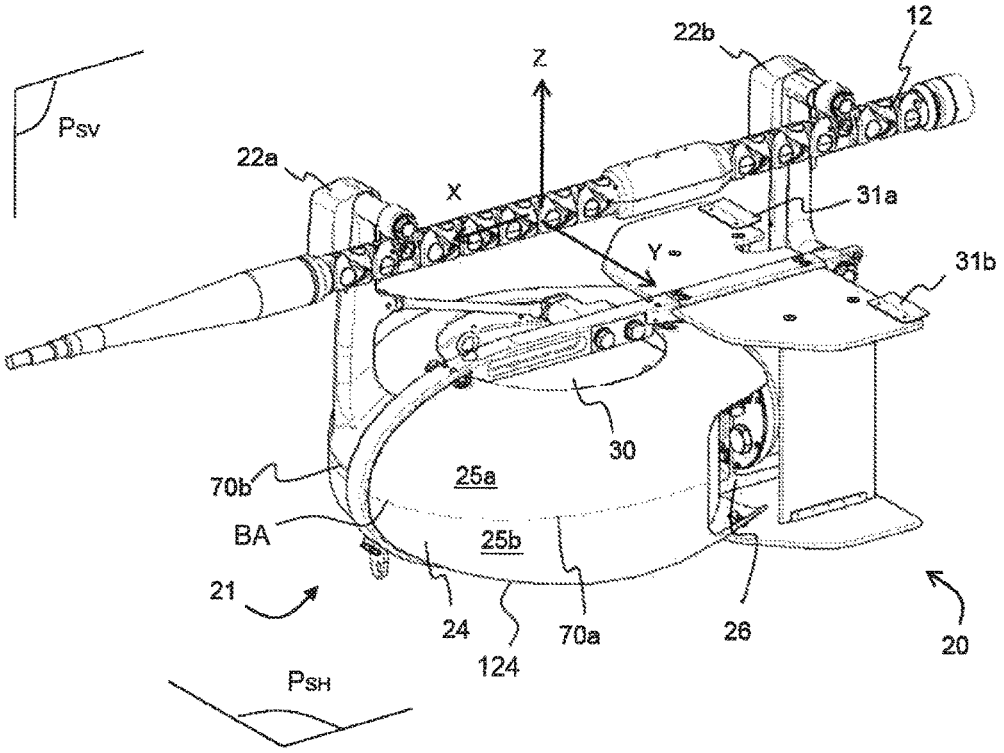
FIGS. 2*a*, 2*b*, 2*c* and 2*d* depict one example of a towed object according to the invention in, respectively, a first perspective view, a second perspective view, a face-on view and a rear view.
Figure 2B:
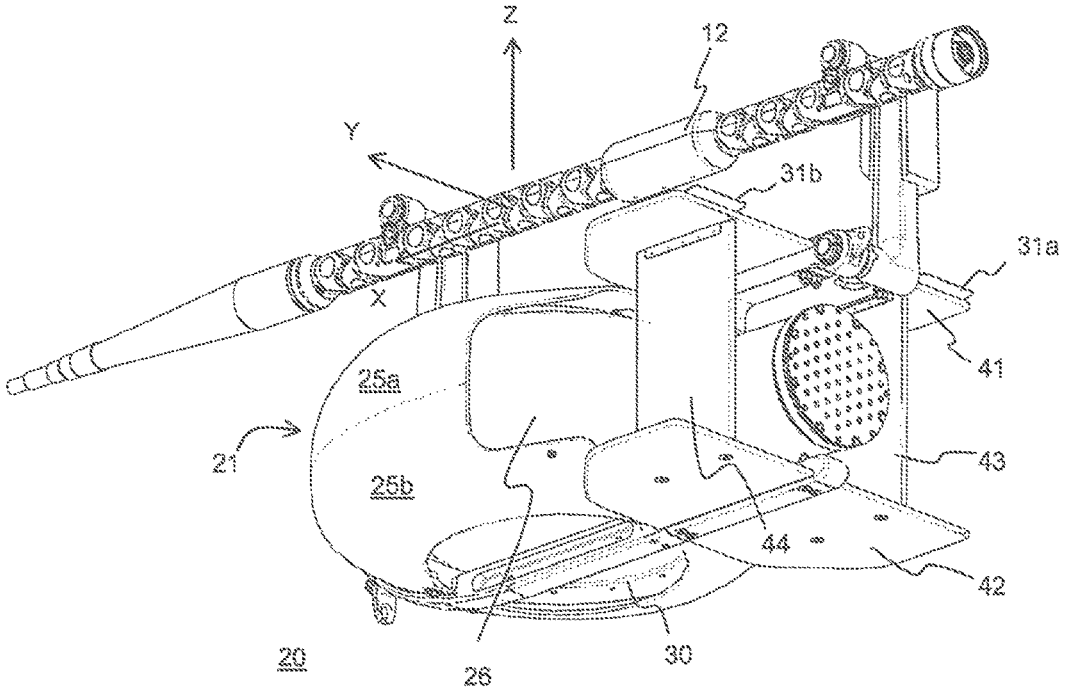
Figure 2C:
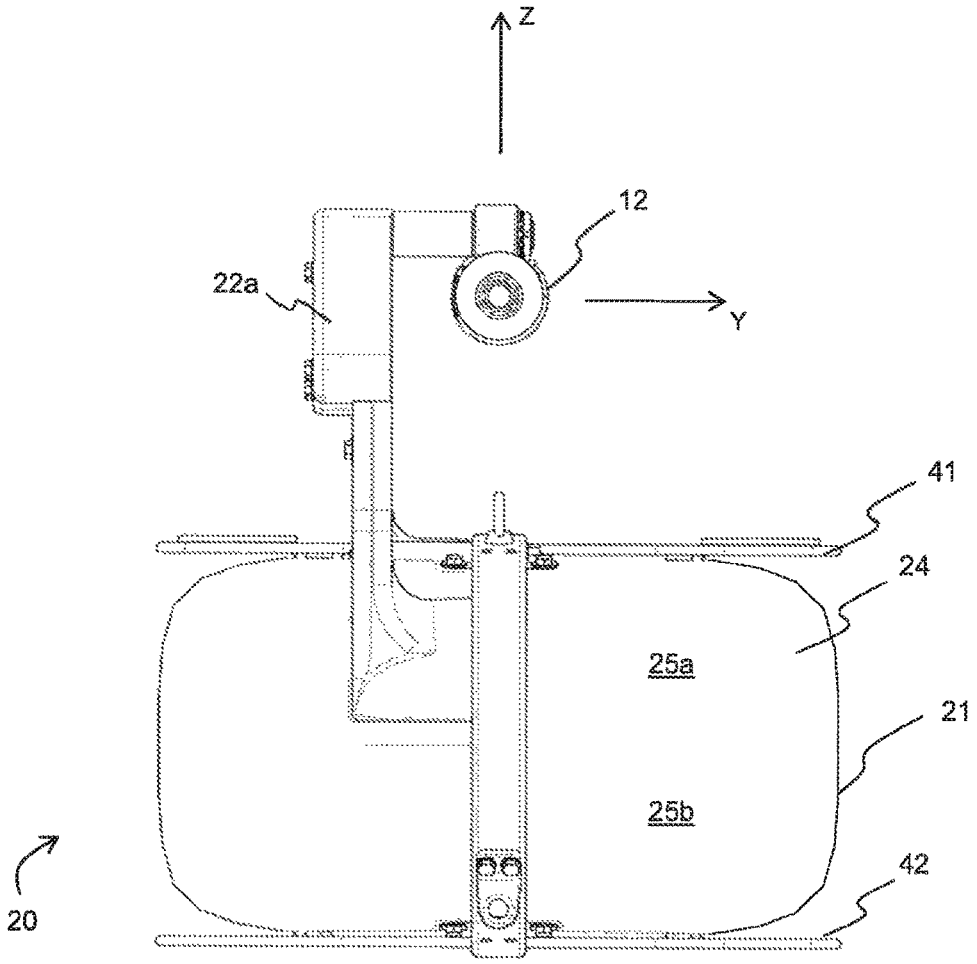
Figure 2D:
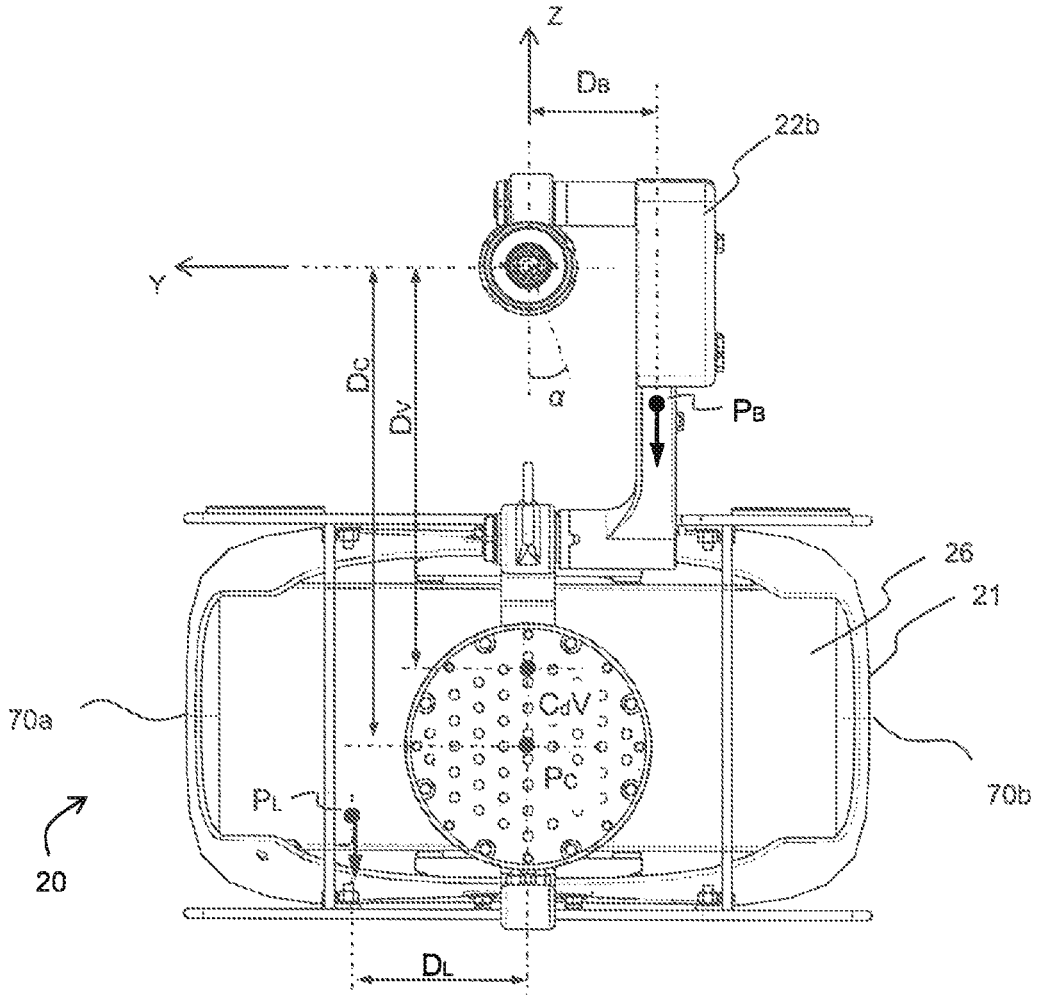

In the example depicted in the figures, the body 21 comprises an exterior surface 24 formed of an upper surface 25*a* and of a lower surface 25*b* which are delimited by an edge in common which is contained in a horizontal plane $P_{SH}$ depicted in FIG. 2*a*. The common edge defines a left-hand lateral profile referenced 70*a* (on the side of the positive values of the axis Y) and a right-hand lateral profile referenced 70*b* (on the side of the negative values of the axis Y). The shape of the body 21 is also defined hereinafter by means of a vertical plane referenced $P_{SV}$ containing the transport axis X.

In order to reduce the vertical lift of the body, the upper 25*a* and lower 25*b* surfaces are preferably substantially symmetric with respect to one another about the horizontal plane $P_{SH}$. Advantageously, each of the two surfaces is also configured so as to form in a vertical plane parallel to the transport axis, and notably in the plane $P_{SV}$, a profile close to a standardized thick NACA profile; this profile on the one hand guaranteeing a vertical lift that is limited and only slightly variable for slightly variable angles of incidence and, on the other hand, limited drag.

What is meant by a profile that is thick in a vertical plane is a profile of which the ratio between the vertical thickness (largest dimension of the profile in the vertical direction) and the chord (length separating the leading edge and the trailing edge of the profile) is greater than 25%. It should be noted that the rear part of the profile, which means to say the part containing the trailing edge, may be truncated. The dimension of the body in the vertical direction is the distance between the lower and upper surfaces.

As depicted in the figures, the body has an overall shape that is substantially flattened along the vertical axis. In other words, the dimensions of the object along the vertical axis are less than the dimensions of the object in the horizontal plane. The body comprises a central opening 30 passing through the body 21 along a vertical axis. The opening opens on the one hand onto the upper surface 25*a* and on the other hand onto the lower surface 25*b*. This opening 30, occupied by the fluid in which the object 20 is immersed, makes it possible to equalize the pressures of the fluid flowing along the upper surface and along the lower surface. This opening limits the interior volume of the body that is available to house equipment such as the emission antenna. However, in one advantageous embodiment of the invention, what is envisioned is an acoustic emission antenna that is in the overall shape of an annulus, positioned around the opening 30, so that the reduction in the volume available in the body as a result of the opening 30 is not a major limitation on the overall effectiveness of the sonar.

The opening 30 passing through the body has, in a horizontal plane, a surface area representing more than 15% of the adjoining horizontal surface with no interior boundary formed from the contour of the projected surface of the body on a plane that is horizontal but limited upstream and downstream by the two vertical planes perpendicular to the transport axis delimiting the extent of the opening 30 along the transport axis (X). That makes it possible to guarantee a good limit on the vertical lift of the body.

In order to reduce the lateral lift on the body, the exterior surface 24 is substantially symmetric with respect to the vertical plane $P_{SV}$ containing the transport axis X. Advantageously, the exterior surface 24 is also configured to form, in a horizontal plane and notably the plane $P_{SH}$, two profiles symmetric with respect to one another about the plane $P_{SV}$ which are similar to a thick standardized NACA profile. In particular, the left-hand lateral profile 70*a* and the right-hand lateral profile 70*b* are advantageously similar to a thick NACA-type profile; this profile on the one hand guaranteeing lateral lift that is limited and only slightly variable for angles of incidence that are slightly variable and, on the other hand, limited drag.

What is meant by a profile that is thick in a horizontal plane is a profile of which the ratio between the horizontal thickness (the largest dimension of the profile in the horizontal direction perpendicular to the transport axis) and the chord (length separating the leading edge and the trailing edge of the profile, is greater than 25%. It should be noted that the rear part of the profile formed by the exterior surface, namely the part containing the trailing edge, may be truncated as it is in the embodiment in the figures. The body therefore does not comprise the trailing edge of the profile formed by the exterior surface 24. The profile comprising the leading edge and the trailing edge is obtained by extrapolating the exterior surface 24 as far as the trailing edge.

The exterior surface 24 is formed by joining the profiles formed in the plane $P_{SH}$ and in the plane $P_{SV}$ on each side of each of these planes so that it forms a hydrodynamic surface.

Advantageously, the body 21 overall has a teardrop shape (with the opening 30 passing through it). The teardrop may be truncated so as not to comprise the trailing edge. The exterior surface is advantageously convex overall.

Advantageously, the body is wholly delimited by the surface 24.

In order to further enhance the stabilization by limiting the effect of lift, it is also envisioned to configure the exterior surface 24 so that, in a vertical plane perpendicular to the transport axis X, it has a curved profile comprising a small vertical portion. In other words, the lateral walls of the body have a low proportion of substantially vertical surface so as to limit the possibility of them generating lateral lift. Note too that the body comprises a lateral opening 26 passing through the body along a horizontal axis perpendicular to the transport axis X and situated in a downstream part of the body making it possible further to reduce the lateral lift of the body. The lateral opening is intended to be occupied by the fluid.

One example of a submersible body 21 having a hydrodynamic shape optimized for reducing the lift of the suspended part of the object has been described by means of the figures. The example depicted employs various measures aimed at reducing, on the one hand, the vertical lift (symmetry with respect to the horizontal plane PSH, NACA profiles in the vertical plane, central opening 30) and, on the other hand, the lateral lift (symmetry with respect to the vertical plane PSH, NACA profiles in the horizontal plane, profiles comprising a small vertical portion, rear lateral opening 26). Of course the invention also envisions a submersible body retaining only some of these measures.

In a particularly advantageous simplified configuration, the body comprises a hydrodynamic exterior surface that is substantially symmetric about the vertical plane $P_{SV}$ containing the transport axis X, making it possible to limit the lateral lift of the object, and comprises an open-ended central opening passing through the body along a vertical axis making it possible to limit the vertical lift. This unique configuration of the body makes it possible to limit the hydrodynamic forces that may be generated perpendicular to the transport axis by the flow of fluid around the body and which are liable to lead to a force in rotation about the transport axis opposing the effect of gravity.

The body 21 is of the single-shell monocoque type. In other words, the body is not made up of multiple shells. It is not possible to isolate a portion that is an incomplete portion of the body, that forms a hydrodynamically profiled independent elementary body.

The body 21 is wholly delimited by a shell 124.

This shell has a single substantially convex continuous front surface: in other words, the fluid impinges on the shell at a single point referred to as the stagnation point (or over a very restricted zone), the object being a single-shell monocoque.

The shell 124 comprises a streamlining or external surface of the shell 124. The streamlining is the exterior surface 24. The streamlining 24 delimits a volume that forms a single hydrodynamically profiled cell. This volume exhibits the shape of a single hydrodynamically profiled cell in any vertical plane and in any horizontal plane.

Advantageously, the thickness of the body 21 corresponding to the dimension of the body 21 along a vertical axis is substantially the same around the entire periphery of the opening 30.

The present invention proposes forming a vertical through-opening 30 in a monocoque body, something which is unusual. The fact of proposing a monocoque body means that it is possible to tow a body of significant volume (and therefore to carry a sonar of significant volume) with limited drag. The fact of forming a vertical through-opening through the body makes it possible to limit its vertical lift. Now, a person skilled in the art conventionally seeks to form a monocoque body that is as homogeneous as possible without through-openings or protrusions, so as to limit its drag. Any irregularity in the profile generates turbulence and therefore drag. Forming a vertical through-opening in a monocoque body therefore impairs its drag rating, and is counterintuitive.

In one particular embodiment, the body 21 comprises a leading edge BA and is delimited, in any vertical plane perpendicular to the transport axis situated between the leading edge BA and the opening 30, by a streamlining that forms a convex or substantially convex curve delimiting a single convex or substantially convex volume. In other words, the exterior surface 24 delimits, in any vertical plane perpendicular to the transport axis situated between the leading edge and the opening 30, a convex or substantially convex single volume. What is meant by substantially convex is that the exterior surface or streamline may contain elements of the structure of the body which project with respect to a convex curve.

In one particular embodiment, the volume is convex in any vertical plane perpendicular to the transport axis. In other words, the exterior surface is, apart from the central opening 30, substantially convex. The body is a monospace body. As an alternative, the volume is convex in any vertical plane perpendicular to the transport axis situated between the leading edge BA of the body 21 and a vertical plane perpendicular to the transport axis situated at a distance from the trailing edge of the surface 24 that is equal to two-thirds of the distance separating the leading edge and the trailing edge of the surface 24.

Another measure aimed at stabilizing the towed object is to fix one or more stabilizing ailerons on a downstream part of the body. In the example depicted in the figures, the object comprises two substantially vertical stabilizing ailerons 43 and 44 fixed on a downstream part of the body 21. The dimensions of the ailerons are, on the one hand, small enough to generate lift that is less than the weight of the object in water for the speed range considered, and, on the other hand, large enough that their stabilizing effect is effective. Furthermore, the use of a slightly asymmetric profile for the ailerons 43 and 44 makes it possible to generate a return moment in yaw, capable of at least partially neutralizing the asymmetry in lift generated by the C-shape of the fixing arms.

By the same principle, the towed object also comprises two substantially horizontal stabilizing ailerons 41 and 42, fixed on a downstream part of the body 21, respectively in the upper part and the lower part. Once again, the dimensions of the ailerons need to be on the one hand sufficiently small that they generate lift less than the weight of the object in water, and, on the other hand, high enough that their stabilizing effect is effective. A slightly asymmetric configuration of the ailerons 41 and 42 makes it possible at least partially to neutralize the roll moment generated by the drag of the fixing arms of the towed body suspended beneath the towing cable.

The example depicted in the figures illustrates the benefit of such an asymmetric configuration of the ailerons. To compensate for the disruptive moment induced by the asymmetry of the fixing arms 22*a* and 22*b*, asymmetry is introduced into the horizontal ailerons by attaching two deflectors 31*a* and 31*b* to the upper horizontal rear aileron 41. The asymmetry of the fixing arms with respect to the vertical plane of symmetry $P_{SV}$, subjected to a nonzero speed in the water, generates a lateral force on the towed object. This force produces a disruptive rolling moment substantially proportional to the square of the speed. In simplified form, this disruptive moment can be expressed using the following relationship:

$$C_P = K_1 * V^2 \tag{4}$$

in which:

$K_1$ is a coefficient defining the hydrodynamic disruption induced by the asymmetry of the fixing arms, and V is the speed of the towed object.

In order to neutralize the effect of this disruptive torque $C_P$ on roll, hydrodynamic asymmetry is created on the object, in this instance by means of the two deflectors 31*a* and 31*b*. As before, the moment generated by this set of deflectors is substantially proportional to the square of the speed. It can be expressed in a simplified form of the type:

$$C_A = K_2 * V^2 \tag{5}$$

in which:

$K_2$ is a coefficient defining the hydrodynamic disruption induced by the set of deflectors, and V is the speed of the towed object.

The set of deflectors is therefore designed to generate a moment $C_A$ which opposes the disruptive moment $C_P$ induced by the asymmetry of the fixing arms. In other words, solving equations (4) and (5) makes it possible to determine the characteristics of the set of deflectors. By configuring the deflectors in such a way as to satisfy the equality $K_1 = -K_2$, the set of deflectors allows the disruption induced by the asymmetry of the fixing arms to be neutralized.

A final measure seeks to stabilize the towed object in terms of yaw. This stabilization is essentially afforded by the towing force $T_C$ exerted by the hydrodynamic drag that the set of towed elements downstream of the object produces. For an active sonar in dependent towing, the movement of the streamer 14 connected to the cable 12, downstream of the towed object, generates hydrodynamic drag which applies to the object, via the cable, a rearward load. The return moment generated by this rear towing force $T_C$ can be expressed through the following simplified relationship:

$$C_L = T_C * L * \sin(\beta)$$

in which:

L is the distance between the attachment points of the fixing arms 22*a* and 22*b*, and β is the yaw angle with respect to the longitudinal axis X of the cable.

Thus increasing the distance L separating the two fixing arms improves the yaw stability of the towed object. In the example depicted in the figures, the fixing arms 22*a* and 22*b* are fixed at two opposite ends along the axis X of the body 21, so as to maximize the yaw stabilization.

In other words, the two fixing arms 22*a* and 22*b* are configured so as to connect, respectively in a first and a second substantially vertical direction, the cable 12 and, respectively, a first and a second end of the body along the transport axis X so that a load tending to part the two fixing arms allows the body 21 to be stabilized about the vertical axis Z.

The invention also relates to a towed system, for example a towed system containing an active sonar, that may be towed by a ship. The system comprises a towing cable and a submersible object as described hereinabove. The object is towed by the ship by means of the towing cable. The system may be supplemented by a tail (of the flexible longilinear body type) that may contain a streamer that receives the acoustic signals.

The invention claimed is:

1. An object intended to be towed in a fluid by a cable along a substantially horizontal transport axis; the object comprising a single-shell monocoque body and at least one fixing arm, the body being intended to be suspended under the effect of gravity from the cable by means of said at least one fixing arm, the object wherein the body comprises:

an exterior hydrodynamic surface that is symmetric with respect to a vertical plane containing the transport axis so as to limit the lateral lift of the body, a central opening passing through the body along a vertical axis, which opening is intended to be occupied by the fluid so as to equalize the pressures of fluid flowing along the exterior surface, so as to limit the vertical lift of the body;

making it possible to limit the hydrodynamic forces that may be generated perpendicular to the transport axis by the flow of fluid around the body and that are liable to lead to a load in rotation about the transport axis by opposing the effect of gravity.

2. The object as claimed in claim 1, wherein the fixing arm has a shape that is asymmetric with respect to the vertical plane containing the transport axis.

3. The object as claimed in claim 2, wherein the fixing arm has the overall shape of a "C", connected by a first end to the body and intended to be connected by a second end to the cable.

4. The object as claimed in claim 2, comprising a ballast weight positioned inside the body and configured so that the center of gravity of the object maintained at zero speed in the fluid is positioned in the vertical plane containing the transport axis.

5. The object as claimed in claim 4, comprising a ballast weight positioned inside the body and configured so that the center of gravity of the object kept immersed in air at zero speed is positioned in the vertical plane containing the transport axis.

6. The object as claimed in claim 1, comprising a ballast weight positioned inside the body and configured so that the center of gravity of the object is positioned in the vertical plane containing the transport axis both when the object is kept submerged at zero speed in water and when the object is kept immersed at zero speed in air.

7. The object as claimed in claim 3, comprising a set of deflectors secured to the body configured to generate a hydrodynamic force by the flow of fluid around the object that neutralizes the hydrodynamic force induced by the asymmetric shape of the fixing arm.

8. The object as claimed in claim 1, wherein the exterior surface comprises an upper surface and a lower surface which are symmetric with respect to one another about a horizontal plane so as to limit the vertical lift of the body.

9. The object as claimed in claim 1, wherein the exterior surface comprises an upper surface and a lower surface, the upper surface or the lower surface is configured so as to form in the vertical plane containing the transport axis a thick NACA-type profile making it possible to limit the vertical lift of the body.

10. The object as claimed in claim 1, wherein the exterior surface is configured so as to form in the horizontal plane a thick NACA-type profile making it possible to limit the lateral lift of the body.

11. The object as claimed in claim 1, wherein the exterior surface is configured to form, in a vertical plane perpendicular to the transport axis, a curved profile, comprising a small vertical portion so as to limit the lateral lift of the body.

12. The object as claimed in claim 1, wherein the exterior surface comprises an upper surface and a lower surface, the upper surface being configured so that the exterior surface forms:

in the horizontal plane a thick NACA-type profile making it possible to limit the lateral lift of the body;

in a vertical plane containing the transport axis, a thick NACA-type profile making it possible to limit the vertical lift of the body, the opening on the one hand onto the upper surface and on the other hand onto the lower surface.

13. The object as claimed in claim 1, wherein the body comprises a lateral opening passing through the body along a horizontal axis perpendicular to the transport axis and situated in a downstream part of the body so as to limit the lateral lift of the body, the opening being intended to be occupied by the fluid.

14. The object as claimed in claim 1, comprising a substantially vertical aileron fixed on a downstream part of the body having a substantially asymmetric hydrodynamic shape configured to stabilize the orientation of the object by generating a moment about a vertical axis.

15. The object as claimed in claim 1, comprising a substantially horizontal aileron fixed on a downstream part of the body having a substantially asymmetric hydrodynamic shape configured to stabilize the orientation of the object by generating a moment about the transport axis.

16. The object as claimed in claim 1, comprising two fixing arms configured so as to connect, in first and second substantially vertical directions respectively, the cable and, respectively, a first and a second end of the body along the transport axis, so that a force tending to separate the two fixing arms makes it possible to stabilize the body about a vertical axis.

17. The object as claimed in claim 1, intended for sonar detection in a marine environment, and comprising an acoustic emission antenna fixed to an internal structure of the body.

18. An active sonar system intended to be towed by a ship, comprising a towing cable that can be connected to the ship and an object as claimed in claim 1, towed by the cable.

19. The active sonar system as claimed in claim 18, comprising a tail containing a longilinear body for receiving acoustic signals.

20. The object as claimed in claim 1, wherein the body is wholly delimited by a shell.

21. The object as claimed in claim 20, wherein the shell comprises an exterior surface delimiting a volume that forms a single hydrodynamically profiled cell.

22. The object as claimed in claim 1, wherein the body has the overall shape of a teardrop.

23. The object as claimed in claim 1, wherein the exterior surface is substantially convex.

24. The object as claimed in claim 1, wherein the dimension of the body along a vertical axis is substantially the same over the entire periphery of the opening.

* * * * *